US012330837B2

(12) United States Patent
Pieper et al.

(10) Patent No.: US 12,330,837 B2
(45) Date of Patent: Jun. 17, 2025

(54) FOOD PACKAGING

(71) Applicants: Stefan Pieper, Remscheidt (DE); Walid Omairat, Erkrath (DE)

(72) Inventors: Stefan Pieper, Remscheidt (DE); Walid Omairat, Erkrath (DE)

(73) Assignee: Smart Catering GmbH & Co. KG, Erkrath (DE)

( * ) Notice: Subject to any disclaimer, the term of this patent is extended or adjusted under 35 U.S.C. 154(b) by 0 days.

(21) Appl. No.: 18/244,573

(22) Filed: Sep. 11, 2023

(65) Prior Publication Data

US 2023/0415954 A1 Dec. 28, 2023
US 2024/0253857 A9 Aug. 1, 2024

Related U.S. Application Data

(63) Continuation of application No. PCT/EP2022/072352, filed on Aug. 9, 2022.

(30) Foreign Application Priority Data

Aug. 19, 2021 (DE) ..... 102021004244.1

(51) Int. Cl.
*B65D 17/50* (2006.01)
*B65D 81/34* (2006.01)

(52) U.S. Cl.
CPC ..... *B65D 17/502* (2013.01); *B65D 81/3453* (2013.01); *B65D 2581/3471* (2013.01)

(58) Field of Classification Search
CPC .... B65D 5/0218; B65D 5/325; B65D 5/2085; B65D 5/0085; B65D 17/502; B65D 81/3453; B65D 2581/3471; B65D 2231/027; B65D 2251/0093; B65D 17/04; B65D 17/32; B65D 1/34
See application file for complete search history.

(56) References Cited

U.S. PATENT DOCUMENTS 8,381,946 B2 * 2/2013 Everson ..... B65D 43/162 220/837
8,955,709 B2 * 2/2015 Lorenz ..... B65D 19/18 220/666
8,985,386 B2 * 3/2015 Everson ..... B65D 43/162 220/839

(Continued)

FOREIGN PATENT DOCUMENTS

DE 202021002810 U1 1/2022
WO WO 2015/193402 A1 12/2015
WO WO 2016/180722 A1 11/2016

*Primary Examiner* — Kareen K Thomas
(74) *Attorney, Agent, or Firm* — Reinhart Boerner Van Deuren P.C.

(57) ABSTRACT

Packaging, in particular pre-packaging, for food, comprising a side part. The side part encloses a receiving space for food, and a bottom part. The bottom part is connected to the side part. The connection between the side part and the bottom part includes, at least partially, a releasable connection. The connection between the side part and the bottom part includes, at least partially, a permanent connection. The permanent connection is at least partially movable. The at least partially movable configuration of the permanent connection allows a hinge effect between the side part and the bottom part. The bottom part can be folded down after an at least partially release of the releasable connection.

16 Claims, 6 Drawing Sheets

(56) References Cited

U.S. PATENT DOCUMENTS

| | | | | |
|---|---|---|---|---|
| 10,017,317 | B2 | 7/2018 | Gillblad | |
| 2005/0133512 | A1* | 6/2005 | Prokopp | B65D 25/108 220/601 |
| 2008/0223739 | A1* | 9/2008 | Thompson | A47G 19/2227 206/217 |
| 2009/0178945 | A1 | 7/2009 | Moehlenbrock et al. | |
| 2015/0367987 | A1* | 12/2015 | Clark | B65D 81/3205 220/610 |
| 2017/0121091 | A1 | 5/2017 | Gillblad | |
| 2019/0112110 | A1* | 4/2019 | Taylor | B65D 43/162 |
| 2021/0362921 | A1* | 11/2021 | Krueger | B65D 55/024 |
| 2023/0278750 | A1* | 9/2023 | Halkowicz | B65D 17/32 220/268 |

* cited by examiner

FOOD PACKAGING

CROSS-REFERENCE TO RELATED PATENT APPLICATIONS

This patent application is a continuation of PCT/EP2022/072352, filed Aug. 9, 2022, which claims priority to German Application No. 10 2021 004 244.1, filed Aug. 19, 2021, the entire teachings and disclosure of both applications are incorporated herein by reference thereto.

FIELD OF THE INVENTION

The invention relates to a packaging, in particular pre-packaging, for food, comprising a side part, the side part enclosing a receiving space for food, and a bottom part, the bottom part being connected to the side part, the connection between the side part and the bottom part at least partially comprising a releasable connection. The invention further relates to a method for serving, in particular for appealingly providing, food, and to the use of the packaging according to the invention for serving, in particular for appealingly providing, food in a large-scale kitchen and/or in a communal catering facility, in particular in a hospital, a retirement home and/or a care facility.

BACKGROUND OF THE INVENTION

Food, especially ready meals, that can be heated in its packaging is becoming increasingly popular. Due to the progress made in recent years in terms of preparation and preservation quality, even high-quality food can be stored for an extended period of time for quick preparation.

Previous packaging for ready-to-eat food is known in various forms, such as bags, bowls, trays; each made of cardboard, metal, plastic, or combined materials. The ready-to-eat food can be prepared in these packaging in a variety of ways, whereby simple heating in a microwave or in a water bath is usually sufficient for consumption. Consumption is possible both directly from the packaging and by transferring the meals to a dish.

The consumption of ready-to-eat food goes hand in hand with a generally visually unappealing presentation during consumption, when the food is eaten out of or in the packaging, respectively, or when it is transferred with spoons, ladles, or other kitchen utensils to a tableware, such as a plate. This often gives the user the impression that the meal is not very tasty, inexpensive, and not of particularly high quality. Such impressions remain in the memory of the purchaser of such ready-to-eat food products, which is why he would be less inclined to buy such a product repeatedly or even pay higher prices, even if it is food made from high-quality ingredients.

Ready-to-eat food should also be ready for consumption quickly because the user demands it or because the food is to be consumed as warm and fresh as possible after preparation. This applies not only to consumer use, but also in communal catering and large-scale kitchen, where the staffing requirements for preparing and making meals available are considerable if rapid serving is intended. If the preparation takes too long, the meals can cool down quickly due to long standing times. In addition, there is a risk of soiling during long standing times, which may mean that existing hygiene concepts cannot be adhered to. In hospitals, retirement homes and care facilities, for example, many millions of people are supplied with food every day. Increasingly, the provision of food is being handled by a central service provider, such as a hospital kitchen or a catering company. Here in particular, "straight-to-plate" presentation plays a decisive role.

It is precisely this requirement for rapid readiness for consumption that entails disadvantages in terms of the visual presentation of the meal, the cleanliness of the administration and overall handling, which the user would like to see in a way that is clean and conveys a high-quality feeling. The modern user, who is concerned about sustainability, also thinks here about ensuring that as little food residue as possible sticks to the packaging to be thrown away, or that the packaging residue does not first have to be cleaned at great expense.

From the prior art, various packagings are known which have as their goal to get a meal onto a plate as quickly and in shape as possible.

The international patent application WO 2016/180722 A1 discloses a food tray having a sidewall module and a bottom removably attached to the sidewall module. The food tray further comprises an additional protective base removably attached to the lower side of the bottom to protect the removable bottom during transportation and handling of the food tray.

The publication US 2017/0121091 A1 relates to a food tray having a removable bottom that is removably attachable to a bottom edge of the food tray and includes a separate removal tab that is fixedly attached to the removable bottom by an attachment portion.

Patent application US 2009/0178945 A1 discloses a resealable packaging having a tray, a food product disposed in the tray, and a laminated lid material hermetically sealed to the tray flange and comprising a substrate film having an outer laminating layer and an inner sealing layer.

A packaging in which the transfer of the meal to the plate takes place is described, for example, in the publication EP 0 760 341 A1, in which the packaging is placed upside down on a plate or bowl after heating, and a slot in the packaging is opened by pulling the sides apart in opposite directions, causing the meal to slide onto the plate or into the bowl.

Another solution is provided by the packaging described in the publication EP 1 874 655 A1 and the publication U.S. Pat. No. 10,017,317 B2, which is placed on a plate and in which the base is pulled out via a tab so that the meal remains on the plate for consumption and the remaining part of the packaging is lifted away. To this end, the known packaging has a peelable bottom configured as a thin film with a peel tab. First of all, the known packaging does not allow consumption of food contained in the packaging, since the bottom does not withstand the use of eating utensils such as a knife or fork but tears even with slight contact. Furthermore, the thin bottom causes problems, especially with frozen meals, because at low temperatures the material of the bottom becomes brittle and the peel-off tab easily tears off when the bottom is removed. The packaging also has a closed frame which is tapered in the direction of the bottom, which is disadvantageous with respect to plate regeneration, i.e. regeneration, e.g. heating, of a frozen meal contained in the packaging, in that the meal contained in the packaging may not be able to pass through the bottom opening of the packaging onto a tableware when frozen, but is blocked by the frame of the packaging. Further, pulling out the bottom may cause portions of the meal to be pressed against the side of the packaging while the bottom is being pulled out, causing the transfer to fail and substantial portions of the food to adhere to the packaging. In addition, you can get your hands dirty on the pulled-out bottom when you put it aside.

The common disadvantage of the previous packaging is that the visual impression of the food suffers when it is transferred to the plate, handling is complicated and there is a risk of failure and/or there is a risk of soiling hands, clothing, dishes, or packaging during the process of transferring the food to the dishes. In both cases, handling may be difficult, the provision of meals may be delayed, or it may even fail. Particularly in large-scale kitchens and in communal catering, it is not possible to ensure that hot meals are provided quickly and hygienically in a manner that is gentle on staff.

BRIEF SUMMARY OF THE INVENTION

There is therefore a need for food packaging that allows the food to be transferred to the dishes quickly and at any time, without the risk of soiling hands or significant portions of the meal not arriving on the plate.

The present invention is therefore based on the object of providing a packaging, in particular pre-packaging, for food, with which the problems known from the prior art can be overcome and which, in particular, enables the food to be transferred from the packaging to the plate in a simple, fast and appealing manner which succeeds at all times, in which no food residues are lost, for example by these remaining stuck to the packaging, and soiling of the user's hands is avoided. Furthermore, the present invention is based on the object of proposing an advantageous method for serving, in particular for appealingly providing, food, as well as an advantageous use of the packaging for serving, in particular for appealingly providing, food in a large-scale kitchen and/or in a communal catering facility, in particular in a hospital, a retirement home and/or a care facility.

According to a first aspect of the present invention, the above-mentioned problem is solved for a packaging, in particular pre-packaging, for food, comprising a side part, the side part enclosing a receiving space for food, and a bottom part, the bottom part being connected to the side part, the connection between the side part and the bottom part at least partially comprising a releasable connection, in that the connection between the side part and the bottom part at least partially comprises a substantially fixed connection.

According to a second aspect of the present invention, the above-mentioned problem is solved by a method for serving, in particular for appealingly providing, food, comprising the steps:

- placing a packaging according to the first aspect on or over a tableware,
- at least partially loosening the releasable connection of the packaging, and
- at least partial opening of the bottom part so that food contained in the packaging can be transferred, in particular slide, from the packaging via the bottom part onto a tableware.

Finally, according to a third aspect of the present invention, a use of the packaging according to the invention is proposed for serving, in particular for appealingly providing, food in a large-scale kitchen and/or in a communal catering facility, in particular in a hospital, a retirement home and/or a care facility.

Exemplary embodiments of the first, second, and third aspects of the invention may be realized according to one or more of the embodiments described below and/or have one or more of the features described below.

Food means, for example, a product intended for human and/or animal consumption. It can thus also be a food with two or more ingredients. Preferably, it is a meal which comprises at least two different constituents. For example, a meal comprises at least one solid ingredient and/or at least one liquid ingredient. For example, a meal may be an appetizer, a main course, a dessert, and/or an intermediate course. For example, the food is a substantially liquid food, in particular a substantially liquid meal, such as a soup or a stew. In particular, the food may be a quick or ready meal. It is conceivable, for example, that the packaging comprises at least one food product, in particular a meal.

It is also conceivable to separate several food products contained in the packaging. If two or more than two food products are contained in the packaging, which should not come into contact with each other, these can, for example, be separated from each other in separate chambers, for example by a partition wall, in the receiving space of the packaging.

In particular, food is arranged on the bottom part of the packaging, in particular draped in an appealing manner. In the packaging, the food is protected from the environment and external influences. For example, the food can be transported and/or stored in the packaging. It is conceivable, for example, that the food in the packaging can be sold to an end consumer or an intermediary, for example a central service provider, such as a hospital kitchen or a catering company.

Various embodiments, in particular shapes, of the packaging according to the first aspect are conceivable. For example, the packaging may be round and/or angular in shape. For example, it is conceivable that the side part encloses a circular or elliptical receiving space. Alternatively, it is conceivable that the side part comprises two or more sides. For example, it is conceivable that the side part comprises three sides and the side part encloses a triangular shape. Alternatively, the side part comprises four sides and comprises an angular, in particular rectangular or square, receiving space. A rectangular outer shape is particularly cost effective in both handling and packaging larger quantities. Other designs, in particular multi-sided and/or asymmetrical side parts, are also conceivable.

It is also conceivable that the food holding space has at least two different diameters. For example, the side part has a larger diameter in an area facing away from the bottom part and a smaller diameter in an area facing the bottom part. It has been shown that this facilitates in particular a filling of food in the packaging.

The side part and the bottom part can, for example, be designed separately or in one piece. One-piece means, for example, that the side part and the bottom part were manufactured by means of casting or injection molding technology, e.g., in one production step. An optionally available lid can also be formed in one piece with the side part and optionally the bottom part, for example. This enables particularly simple manufacture of the packaging. In addition, for example, a risk of scalding, in particular in the case of liquid food, due to insufficient welded joints can be avoided. In particular, the side part and the bottom part can be formed at least partially separately from one another or at least partially in one piece. For example, a connection of the side part to the bottom part via a corner is conceivable. Alternatively, an at least substantially rounded connection is also conceivable.

For example, the side part is at least partially connected to the bottom part at an angle of substantially 90°. It is also conceivable that the connection of the side part to the bottom part deviates at least partially from a 90° angle. For example, the receiving space of the packaging is at least partially tapered or enlarged in the direction of the bottom part. In particular, the receiving space of the packaging is at least partially tapered in the direction of the bottom part by 0.5 to 5°, preferably by 1 to 3°. In particular, the side part, preferably at least one side, is at least partially inclined by 0.5 to 5°, preferably by 1 to 3°, deviating from a 90° angle. This serves, for example, to improve the stackability of the packaging, so that two or more packagings can be stacked inside one another in a simple manner. This in turn enables, for example, efficient transport of two or more empty packagings.

Preferably, the proportion of the releasable connection is at least half, preferably at least ⅔, particularly preferably ¾ or more than ¾ of the connection between the side part and the bottom part. In this way, it is advantageously possible to unfold the bottom part after the releasable connection has been released. The bottom part can in particular be folded down after an at least partial release of the releasable connection. The bottom part can then serve in particular as a ramp for transferring the food to a tableware or the like. Provided that it is a substantially angular packaging having a side part with two, in particular three, or more sides, in particular four sides, it is preferred that the substantially fixed connection extends, for example, at least partially over only one of the sides. In this way, the folding down of the bottom part is particularly favored. In particular in the case of a multisided side part, it is conceivable that the substantially fixed connection extends over, for example, only two or more sides.

The packaging can be reusable or disposable. Disposable packaging or non-returnable packaging is usually made for single use. Preferably, the packaging can be re-used after use, in particular recycled. This advantageously provides a particularly sustainable packaging. Reusable packaging, on the other hand, can be used multiple times, in particular emptied and refilled after a transport, sale, and/or use. For example, the releasable connection between the side part and the bottom part can be closed again after it has been detached for the first time.

The packaging is particularly suitable for ready-to-eat quick or ready-to-eat meals, the ingredients of which are heated in a microwave oven or in an oven.

In particular, the packaging is a pre-packaging. Pre-packagings are packagings of any kind in which products are packed and sealed in the absence of the purchaser, and the quantity of the product contained therein cannot be changed without opening or noticeably changing the packaging.

While the releasable connection between the side part and the bottom part is configured to be releasable, the essentially fixed connection means a connection that is not easily releasable, for example not without the use of force, but rather permanent.

The packaging preferably has a top side arranged in particular opposite the bottom part. The top side is open, for example, to be filled with food. In particular, food, for example a meal, is served, in particular appealingly draped, on the bottom part via the open top side. Subsequently, the top side may be closed, for example, by means of a lid, in particular a removable and/or resealable lid, for example a film. The closed packaging with the food contained therein can be sold, for example, to an end consumer or an intermediary, for example a central service provider, such as a hospital kitchen or a catering company.

The purchaser and/or user of the packaging can transfer the food contained in the packaging, in particular the draped food, for consumption via the bottom part, for example onto a tableware. For this purpose, in particular the releasable connection between the side part and the bottom part is released, which results in particular in the bottom part being able to fold downwards. The top side can be open, for example, or closed with the aid of a lid.

The food can be heated in the packaging before consumption, for example. Among other things, the invention offers the advantage that no contact with the food is necessary in order to serve it out of the packaging onto a tableware, in particular to drape it appealingly. On the one hand, this is particularly hygienic, and on the other hand, a risk of scalding of heated food is also considerably reduced. In particular, the packaging permits rapid and contactless, hygienic serving of food contained in the packaging.

Furthermore, the packaging according to the first aspect is also particularly advantageous in connection with frozen foods. Contactless transfer of frozen food to a tableware, for example for plate regeneration, is also conceivable.

Thus, the packaging according to the first aspect allows easy transfer and appealing presentation of food contained in the packaging in both frozen and heated states.

In particular, the food can be served without changing its shape. For example, after serving the food, the empty packaging can be removed without affecting the presentation of the food and optionally reused.

For example, the invention serves to transfer a meal from the packaging to, for example, a plate for receiving the meal. After the releasable connection has been released, the bottom part of the packaging can, for example, fold down under its own weight and the meal can slide onto the plate. It is also conceivable that the packaging is placed onto a tableware and is lifted after the releasable connection is released, so that the bottom part opens downwards due to the weight acting in the direction of the tableware and the lifting of the packaging upwards and/or sideways, and the food can also slide onto the tableware. Partial release of the bottom part allows the food to be brought into contact with the tableware, in particular without having to modify and/or remove the side part of the packaging.

Tableware refers to utensils used in the consumption of food, especially meals, in particular plates, platters, and bowls. Tableware can be made of various materials, with porcelain, stoneware, earthenware, plastic, wood and/or glass being the most common. In addition, disposable tableware made of cardboard, aluminum, plastic and/or foamed plastic is also used, e.g., for consumption on the go, and in some cases also made of consumable (e.g., wafers) or compostable, natural materials such as wood.

In particular, the present invention makes it possible to avoid the disadvantages known from the prior art. In particular, it has been shown that a simple, fast, and clean transfer of the food onto a tableware, such as a plate, platter, bowl, or tray, is made possible, which is readily accomplished. The food can be served out of the packaging with almost no residue, in particular without the use of serving tools and avoiding soiling. In particular, the bottom part can be folded down after at least partial release of the releasable connection and can serve as a ramp for transferring the food onto a tableware or the like.

The invention also avoids jamming larger parts of the food at the side of the packaging, which means that they are either lost or have to be scraped out with further effort. As a result, the loss of food parts is extremely low. Moreover, if the packaging is disposed of after the food has been transferred onto a tableware, it hardly contains any odorous or unhygienic residues. After the food has been transferred onto the tableware, for example, the bottom part can be folded up again and the packaging can be disposed of without the risk of food residues falling out and causing soiling.

With the aid of the invention, it is regularly possible to transfer and appealingly serve the food, for example, onto a tableware. This can be advantageous both for the private sector and for the business sector, for example in large-scale kitchens and/or communal catering.

For example, the process of serving food can be significantly simplified and automated. In this way, costs can be reduced both in the personnel area and, for example, in the logistics area, especially in large-scale kitchens and/or communal catering, thanks to the fast and simple handling. In particular, further processing can be carried out in confined spaces.

In particular, the invention can be used to heat a variety of portioned food products simultaneously and, for example, to bring them to the table substantially simultaneously, even in the case of larger groups.

According to a first advantageous embodiment of the invention, the releasable connection comprises at least one means for releasably connecting the bottom part to the side part, in particular a releasable tear strip. In particular, a means for releasably connecting the bottom part to the side part permits a substantially fixed connection of the bottom part to the side part until the releasable connection is released. In this manner, for example, safe, secure transportation and/or storage of food contained in the packaging is possible. At the same time, however, the means for releasably connecting allows the connection between the bottom part and the side part to be released.

The means for releasably connecting is, for example, a tear strip. Such a tear strip offers easy handling, in particular easy release of the connection, while ensuring the stability of the packaging in the unreleased state. It is also conceivable that the means for releasably connecting is a material weakening in the region of the releasable connection. If required, the bottom part can be at least partially released from the side part in the region of the material weakening. However, a disadvantage of this embodiment may be a lack of stability of the unopened packaging.

Preferably, the at least one means for releasably connecting the bottom part to the side part comprises at least one means for releasing the releasable connection, in particular at least one tab. A means for releasing the releasable connection simplifies the release for the user of the packaging. For example, it may be a tab that the user can grasp to release a tear strip, for example.

The at least one means for releasably connecting the bottom part to the side part can, for example, have two (releasable) ends, the (releasable) ends preferably being arranged symmetrically, in particular opposite one another, on the packaging. In this way, symmetrical opening of the bottom part and preferably straight, uniform folding down of the bottom part is made possible. The bottom part forms, for example, a ramp over which food contained in the packaging can slide onto a tableware.

For example, the at least one means for releasing the releasable connection of the bottom part to the side part is arranged in such a way that releasing the releasable connection is simplified especially for left-handed or right-handed persons. It is conceivable, for example, that a means for releasing the releasable connection, for example a tab, is arranged at one end of the means for releasably connecting, for example at a tear strip, while the other end of the means for releasably connecting the bottom part to the side part does not comprise a means for releasing the releasable connection of the bottom part to the side part. For example, the releasable connection is to be released in only one direction. Conceivably, the means for releasing the releasable connection of the bottom part with the side part is arranged in such a way that it allows left-handed persons to hold the packaging with the right hand and to release the releasable connection with the left hand, for example from left to right. Conversely, this can equally apply to an embodiment for right-handers.

Particularly preferably, the at least one means for releasably connecting the bottom part to the side part has two means for releasing the releasable connection, in particular two tabs, the means for releasing the releasable connection being arranged at opposite ends of the means for releasably connecting the bottom part to the side part, in particular the tear strip. In this way, the releasable connection can be released from both sides and thus in a particularly simple manner by both left-handed and right-handed persons.

The bottom part is preferably essentially rigid. On the one hand, a substantially rigid configuration of the bottom part enables safe transport of the packaging and optionally of food contained therein. In addition, a substantially rigid bottom part allows the food to slide out of the packaging onto, for example, a tableware without changing the arrangement of the food, for example a meal, as specified in the packaging during serving.

A substantially rigid configuration means that the bottom part retains its, for example, flat shape despite the weight of food, for example a meal, on the bottom part. In particular, the bottom part neither sags nor tears under the load of the food. However, it is conceivable, for example, that the bottom part can be bent or torn. It is also conceivable that the bottom part can neither be bent nor torn. In particular, the substantially rigid embodiment of the bottom part allows the food, in particular the meal, to slide uniformly onto a tableware. In addition, a rigid configuration of the bottom part can in particular prevent transport and/or temperature damage to the packaging.

The bottom part may have a thickness of at least 0.20 mm, preferably at least mm, particularly preferably at least 0.60 mm. For example, the bottom part has a thickness of more than 0.40 mm, in particular at least 0.45 mm, preferably at least 0.55 mm. This has in particular the advantage that the packaging is also suitable for direct consumption of contained food out of the packaging. The packaging also withstands the use of eating utensils, such as knives or forks, due to a more stable configuration of the bottom part. For example, the bottom part has at least partially a greater thickness than the side part. This is particularly advantageous in that the bottom part supports the weight of the food, in particular the meal.

The bottom part and/or side part preferably at least partially have a thickness of 0.2 to 2.0 mm, preferably 0.3 to 1.0 mm, particularly preferably 0.60 to 0.75 mm. Particularly preferably, the bottom part and/or the side part have a substantially uniform thickness. However, it is conceivable, for example, that the thickness deviates at one or more points, e.g., is increased at certain points, for manufacturing reasons. An appropriate configuration of the packaging, in particular of the bottom part and/or the side part, can ensure that it has a low weight, while at the same time the packaging is stable so that it is not damaged during transport and/or handling.

For example, the side part has at least partially a thickness of 0.50 to 0.70 mm, preferably 0.55 to 0.65 mm, in particular 0.60 mm, and/or the bottom part has at least partially a thickness of 0.60 to 0.80 mm, preferably 0.70 to 0.75 mm, in particular 0.70 mm. On the one hand, this permits a material-saving and lightweight configuration of the packaging and, on the other hand, a stable configuration, in particular of the bottom part.

It is also conceivable that the bottom part has at least two different thicknesses. In particular, the bottom part has a higher thickness, for example in a flow area where the food passes from the bottom part onto a tableware, which gives the bottom part additional stability at this point and also makes it easier to fold down the bottom part after the releasable connection has been released. For example, the bottom part has at least partially a thickness of 0.70 mm and partially, in particular at least partially in the flow area, a thickness of 0.75 mm.

According to a further advantageous embodiment of the invention, the substantially fixed connection is at least partially movable, in particular flexible. An at least partially movable, in particular flexible, configuration of the substantially fixed connection between the side part and the bottom part allows the bottom part to be opened, in particular with the weight of food contained in the packaging, without the fixed connection between the side part and the bottom part breaking or tearing as a result of the movement. In particular, an at least partially movable, in particular flexible, configuration of the substantially fixed connection allows a hinge effect between the side part and the bottom part, which in particular allows an advantageous unfolding after the releasable connection has been released.

The substantially fixed connection is configured, for example, in the manner of a hinge and/or joint. Preferably, the packaging, in particular the substantially fixed connection, is configured in such a way that the bottom part folds down and/or does not spring back unintentionally after the releasable connection is released, even when the packaging is unfilled. This is particularly advantageous in order to permit folding down after the releasable connection has been released even, for example, in the case of very light food or, for example, in order to prevent the bottom part from springing back and thus, for example, splashing of residues present on the packaging after the food contained in the packaging has been transferred onto, for example, a tableware, for example, as a result of tension present in the substantially fixed connection.

For example, the substantially fixed connection at least partially comprises a material weakening. It is conceivable, for example, that the substantially fixed connection has at least partially the thickness of the side part and/or the bottom part. It is also conceivable that the substantially fixed connection has, at least in part, a thickness less than the thickness of the side part and/or the bottom part. For example, the substantially fixed connection at least partially comprises a reduced thickness compared to the side part and/or the bottom part of, for example, 0.05 to 0.20 mm, particularly preferably 0.10 mm. This can, for example, advantageously allow the bottom part to be folded down even when the packaging is empty and/or prevent the bottom part from springing back unintentionally, in particular after the packaging has been emptied, while the substantially fixed connection nevertheless ensures a connection between the bottom part and the side part that cannot be released without further effort, for example, not without a major effort or the use of force.

According to another advantageous embodiment of the invention, the bottom part comprises at least partially a non-stick surface, in particular a non-stick coating and/or a non-stick structure. A non-stick surface reduces the ability of materials to adhere to the surface. In particular, a non-stick surface, in particular a non-stick coating and/or a non-stick structure, is used to reduce friction between the bottom part and food that is in the packaging. In this way, the food can advantageously be served from the packaging with virtually no residue. In particular, the food slides over the bottom part onto a tableware without changing the arrangement of the food, in particular a meal. It is also conceivable that the side part has a non-stick surface.

It is conceivable, for example, that the bottom part and/or the side part has at least partially a nano-coating. For example, a nano-coating is used to smooth the surface of the bottom part and/or the side part, thereby reducing friction in a simple and cost-effective manner.

It is also conceivable that the bottom part is at least partially polished in such a way that the friction between the bottom part and food contained in the packaging is reduced.

The side part and/or the bottom part preferably comprises a heat-resistant, preferably microwaveable material, in particular plastic and/or light metal. After the packaging has been filled with food and optionally provided with a lid, for example sealed with a film, the food can be transported and/or stored in the packaging, for example. In order to prepare the food for later consumption, for example, the packaging with the food is placed in a microwave oven or an oven in order to heat the food. Heat-resistant, in particular microwaveable, material for the side and/or bottom part is therefore preferred. Alternatively, or additionally, it may be a freeze-resistant material.

For example, the material has a temperature resistance of −50° C. to +150° C., in particular −40° C. to +125° C. A correspondingly configured side and/or bottom part is both freeze-resistant and suitable for microwaving.

Preferably, the packaging is made predominantly, in particular completely, from one material. This simplifies production on the one hand and disposal, in particular recycling, of the packaging on the other. In particular, the side part and/or the bottom part comprise at least partially, in particular completely, the same material. An optionally present lid also preferably comprises at least partially the same material as the side part and/or the bottom part. In this way, a particularly sustainable packaging is provided.

Preferably, light metal and/or plastic is used for the side and/or bottom part of the packaging. In particular, manufacture from recyclable raw materials is conceivable.

Preferably, the packaging further comprises a releasable and/or resealable lid. For example, the packaging may be closed, in particular sealed, by means of a film after being filled with food, in particular after draping food, in particular a meal. Food contained in a sealed packaging may, for example, have a specific best-before date.

It is also conceivable that the packaging comprises a resealable lid. In particular, the packaging may be suitable for multiple use, especially in that it may be emptied and refilled after transport, sale and/or use. In particular, the packaging may be individually filled. For example, the releasable connection between the side part and the bottom part can be resealed after an initial release.

A lid encompassed by the packaging may be made of different materials, for example at least partially of the same material as the bottom part and/or the side part. Preferably, a lid may be a transparent film which is attached to the upper edge of the side part after the at least one food product has been placed in the receiving space, in particular on the bottom part, of the packaging. In particular, an existing lid does not have to be removed from the packaging in order to transfer the food onto a tableware, for example. This allows easier application of the lid with higher tolerances.

According to a further advantageous embodiment of the present invention, the bottom part comprises at least one bottom section and at least one side section, the bottom section being at least partially connected to the side section at an angle of not equal to 0°, in particular of substantially 90°, preferably formed integrally with the side section.

In particular, the bottom section forms at least part of the bottom of the packaging. At least one food product can be accommodated on the bottom section, for example.

The at least one side section is preferably integrally connected to the at least one bottom section. One-piece means, for example, that the side section and the bottom section have been manufactured by means of casting or injection molding technology, e.g., in one manufacturing step.

For example, the at least one side section at least partially surrounds a receiving space for food contained in the packaging. The at least one side section is connected to the bottom section at an angle of not equal to 0°, for example 1° to 90°. In particular, the at least one side section is at least partially connected to the bottom section at an angle of substantially 90°. It is also conceivable that the connection of the side section to the bottom section at least partially deviates from an angle of 90°. Preferably, the at least one side section is at least partially aligned with the side part of the packaging. For example, the at least one side section has at least partially substantially the same thickness as the bottom part and/or the side part.

In particular, it is conceivable that the bottom part, in particular the at least one bottom section, is releasably and/or substantially fixedly connected to the side part at least partially via the at least one side section.

Particularly preferably, the bottom part, in particular the at least one bottom section, is at least partially substantially fixedly connected to the side part via at least one side section. After releasing the releasable connection, for example, the bottom section of the bottom part folds down, while the at least one side section, which is at least partially substantially fixedly connected to at least a part of the side part, rather folds upwards and/or to the side. This facilitates, in particular, a contactless transfer of frozen foods onto a tableware as well as a subsequent plate regeneration. Surprisingly, it has been shown that frozen food contained in the packaging can also be transferred, in particular slide, onto a provided tableware in a simple manner, in particular by folding down the at least one bottom section and folding up or to the side the at least one side section, and blocking in the packaging can be avoided. In particular, users such as, for example, hospitals or institutions for the elderly can thus regenerate frozen food contained in the packaging not exclusively in ovens, convection ovens or microwaves, but moreover also, for example, in so-called active food distribution trolleys, in which the meal is regenerated directly onto a tableware, for example a plate covered with a glouche. The packaging according to the first aspect thus allows easy transfer and appealing arrangement of food contained in the packaging, in particular in a frozen state.

It is also conceivable that the bottom part, in particular the at least one bottom section, is at least partially releasably connected to the side part via the at least one side section. After releasing the releasable connection, for example, both the bottom section and the side section fold down. In particular, the at least one side section is configured such that it supports the transfer, in particular sliding, of food, in particular a meal, from the bottom section of the packaging onto, for example, a tableware. Particularly in the case of liquid food, in particular meals, such as a soup or a stew, or also pureed food, there is a risk that these do not completely pass onto the tableware, but instead run down, for example, laterally from the bottom part of the packaging. The at least one side section, on the other hand, can serve as a guide for transferring the food as completely as possible onto the plate and, in addition, also as a splash guard, in particular the side section acts as a raised edge. A risk of scalding in the case of heated food can thus also be prevented.

Preferably, the packaging comprises at least one retaining element, in particular an at least partially circumferential sealing edge. The retaining element serves, for example, for gripping and/or holding the packaging. For example, the retaining element is a handle on the side part of the packaging. However, it is also conceivable to have, for example, a sealing edge at least partially surrounding the side part. The retaining element, in particular the sealing edge, can, for example, be of different thicknesses at different points. It is conceivable, for example, that the sealing edge is thicker, e.g. with a thickness of substantially about 1.00 mm, in areas which are subject to particular stress when the releasable connection is released, e.g. in the area of the means for releasing the releasable connection, than in comparably less stressed areas of the packaging, in particular of the side part, which e.g. have a thickness of substantially only about 0.60 mm.

The features and embodiments of the invention described above may equally relate to the various aspects according to the present invention. In particular, with the disclosure of features relating to the packaging according to the first aspect, corresponding features relating to the method and use according to the second and third aspects are also disclosed. The exemplary embodiments of the present invention previously described in this description are also intended to be understood as disclosed in all combinations with each other. Rather, it is to be understood that the description of embodiments of the invention is merely exemplary and not limiting.

Further advantageous exemplary embodiments of the invention will be found in the following detailed description of some exemplary embodiments of the present invention, particularly in connection with the figures. However, the figures are intended only for the purpose of clarification and not for determining the scope of protection of the invention. The figures are not to scale and are intended merely to reflect the general concept of the present invention by way of example. In particular, features included in the figures are in no way intended to be considered a necessary part of the present invention.

BRIEF DESCRIPTION OF THE DRAWINGS

The drawing shows in

DETAILED DESCRIPTION OF THE INVENTION

Figure 1:
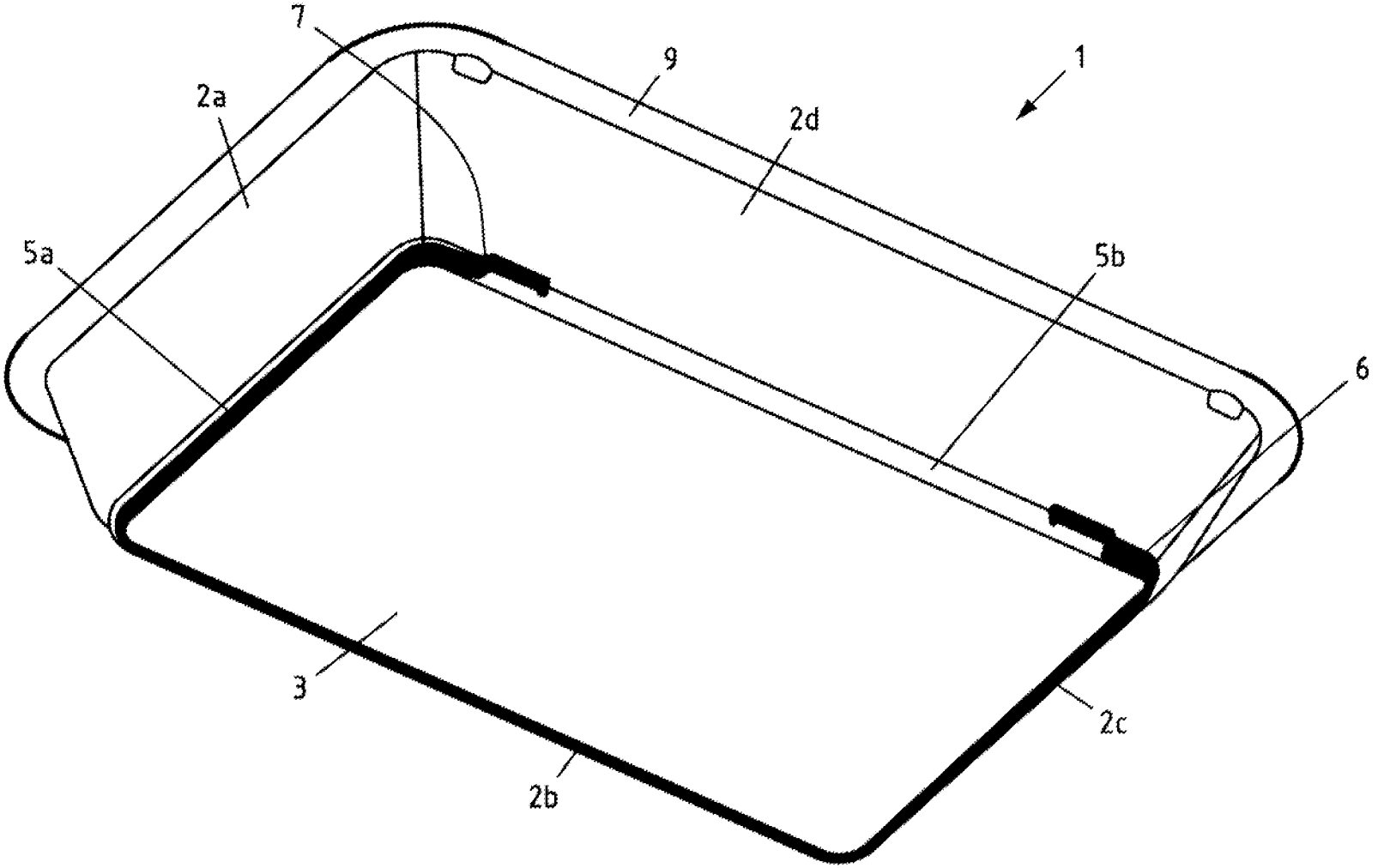
FIG. 1 in a schematic representation, a first embodiment of the packaging according to the invention according to the first aspect, FIG. 2 in a schematic representation, the first embodiment of the packaging according to the invention of the first aspect during a step of the method according to the invention according to the second aspect, FIG. 3 in a schematic representation, a second embodiment of the packaging according to the invention according to the first aspect, FIG. 4 in a schematic representation, a third embodiment of the packaging according to the invention according to the first aspect, FIG. 5 in a schematic representation, a fourth embodiment of the packaging according to the invention according to the first aspect, and FIG. 6 in a schematic representation, a fifth embodiment of packagings according to the invention according to the first aspect.

FIG. 1 shows an exemplary embodiment of a packaging for food according to the first aspect. In the present embodiment, the packaging 1 has the shape of a rectangular menu tray. The packaging 1 comprises a releasable and/or resealable lid 9. For example, the lid 9 is a peelable film. In addition, the packaging 1 comprises a side part 2*a*, 2*b*, 2*c*, 2*d* enclosing a receiving space (not shown). In the present case, the side part 2*a*, 2*b*, 2*c*, 2*d* comprises four straight sides, two opposite sides having the same length in each case.

Further, the packaging 1 comprises a bottom part 3 which is connected to the side part 2*a*, 2*b*, 2*c*, 2*d*. Preferably, the side part 2*a*, 2*b*, 2*c*, 2*d* and/or the bottom part 3 comprises a heat-resistant, particularly preferably microwaveable material, in particular plastic and/or light metal.

The connection 5*a*, 5*b* comprises at least in part a releasable connection 5*a* and at least in part a substantially fixed connection 5*b*. The releasable connection 5*a* extends completely over three of the four sides of the side part 2*a*, 2*b*, 2*c*, 2*d* and over the fourth side at least partially. The substantially fixed connection 5*b* extends over a portion of the fourth side of the side part 2*a*, 2*b*, 2*c*, 2*d*.

While the bottom part 3 is permanently connected to the side part 2*a*, 2*b*, 2*c*, 2*d* by the substantially fixed connection 5*b*, the releasable connection 5*a* can be released by releasing the means 6 for releasably connecting the bottom part 3 to the side part 2*a*, 2*b*, 2*c*, 2*d*. In the present case, the means 6 for releasably connecting the bottom part 3 to the side part 2*a*, 2*b*, 2*c*, 2*d* comprises a tear strip. Further, the means 6 for releasably connecting the bottom part 3 to the side part 2*a*, 2*b*, 2*c*, 2*d* comprises two means 7 for releasing the releasable connection 5*a*, which are in the form of tabs. The tear strip has two opposite ends, at each of which a tab is arranged. In this way, the packaging 1 is symmetrically configured, which also enables symmetrical release of the releasable connection 5*a*.

The bottom part 3 of the packaging 1 preferably has at least partially a non-stick surface (not visible), in particular a non-stick coating and/or a non-stick structure.

The packaging 1 is suitable for use for serving, in particular for the appealing provision, of food, for example in a large-scale kitchen and/or in a communal catering facility, in particular in a hospital, a retirement home and/or a care facility.

The packaging 1 allows to perform a method for serving, in particular for appealingly providing, food comprising the steps of placing the packaging 1 onto a tableware, at least partially releasing the releasable connection 5*a* of the packaging 1, at least partially opening the bottom part so that food contained in the packaging can be transferred, in particular slide, from the packaging onto a tableware via the bottom part.

Figure 2:
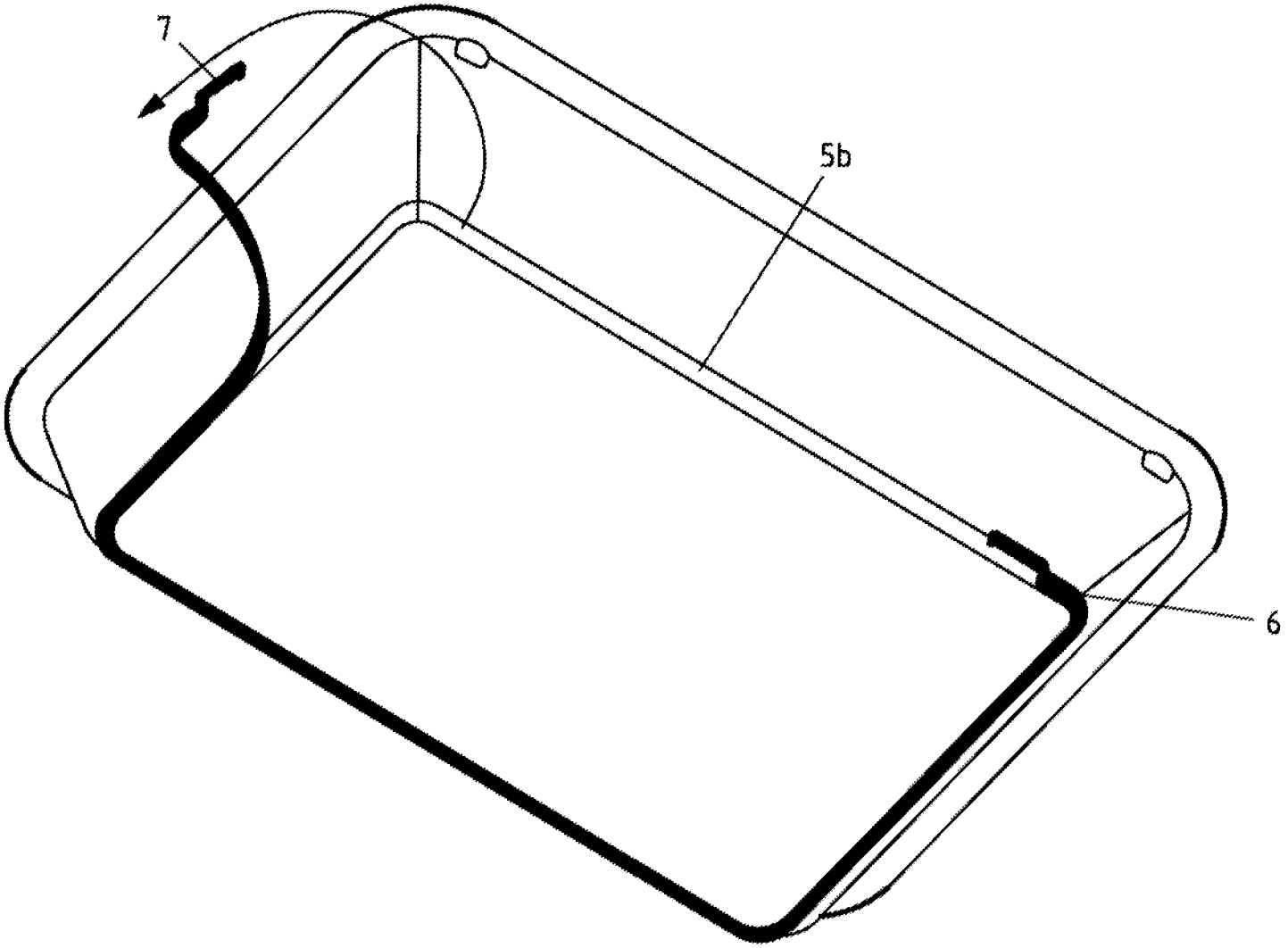

FIG. 2 shows the packaging 1 during at least partial release of the releasable connection 5*a* of the packaging 1. The user of the packaging 1 can release the tear strip to the side, for example, and thus release the releasable connection 5*a* between the side part 2*a*, 2*b*, 2*c*, 2*d* and the bottom part 3. Alternatively, the tear strip can be peeled off at the other tab or simultaneously at both tabs.

At the fourth side of the side part, to which the tear strip is only partially attached, there is a permanent substantially fixed connection 5*b* between the side part 2*a*, 2*b*, 2*c*, 2*d* and the bottom part 3.

Figure 3:
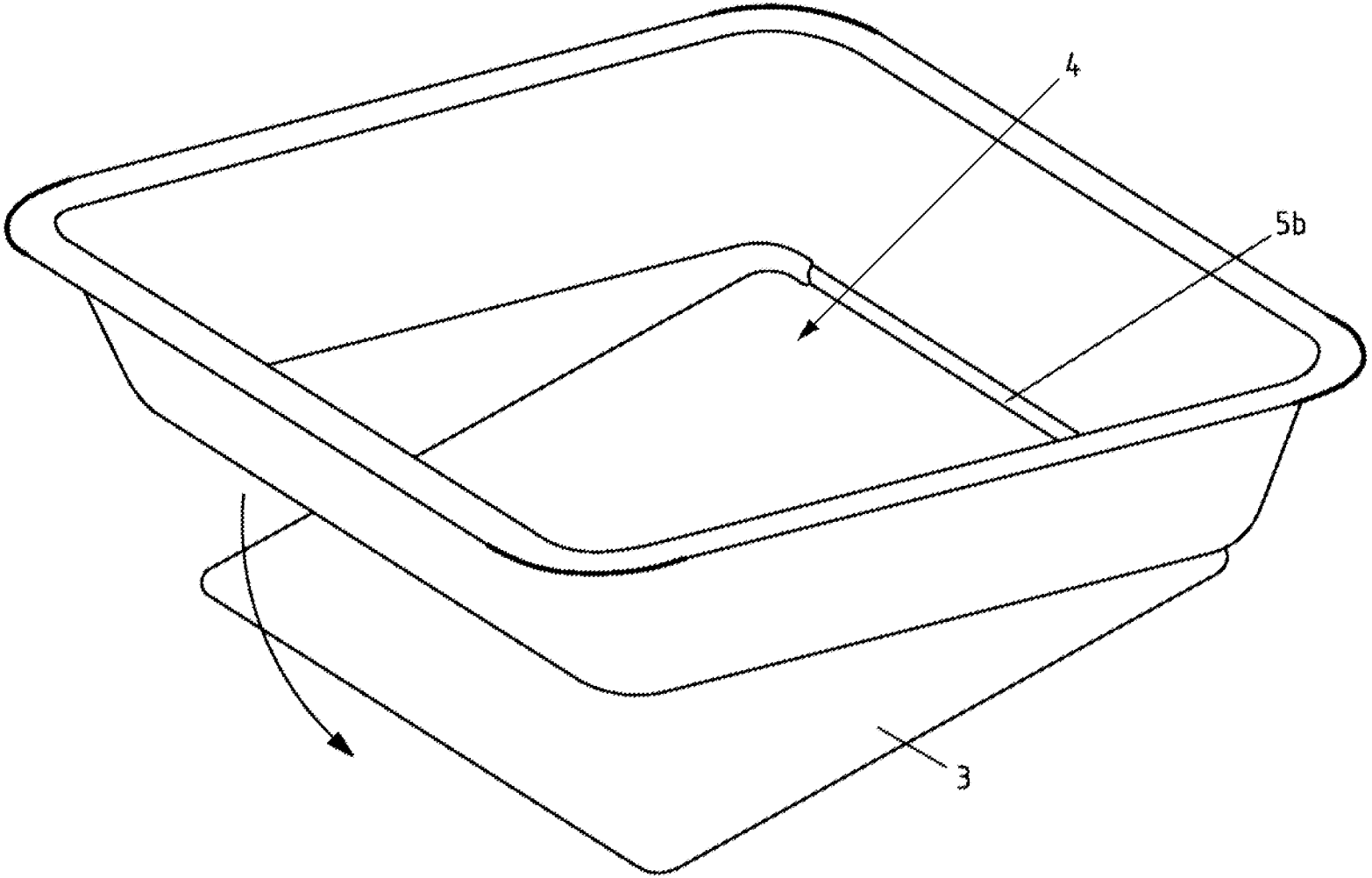

FIG. 3 shows a second embodiment of the packaging according to the first aspect. In the present case, the means 6 for releasably connecting the bottom part 3 to the side part 2*a*, 2*b*, 2*c*, 2*d*, for example the tear strip shown in FIG. 2, has already been removed, thus releasing the releasable connection 5*a* of the bottom part 3 to the side part 2*a*, 2*b*, 2*c*, 2*d*.

The bottom part 3 of the packaging 1 is essentially rigid. By releasing the releasable connection 5*a*, the bottom part 3 folds down at the sides which are no longer connected to the bottom part 3. However, the bottom part 3 is still connected to the side part 2*a*, 2*b*, 2*c*, 2*d* via the substantially fixed connection 5*b*. In the present case, the substantially fixed connection 5*b* between the bottom part 3 and the side part 2*a*, 2*b*, 2*c*, 2*d* is configured to be at least partially movable, in particular flexible. In this way, the substantially fixed connection 5*b* acts like a joint and allows the bottom part 5*b* to be folded down.

The bottom part 3 of the packaging 1 preferably has at least partially a non-stick surface (not visible), in particular a non-stick coating and/or a non-stick structure.

Figure 4:
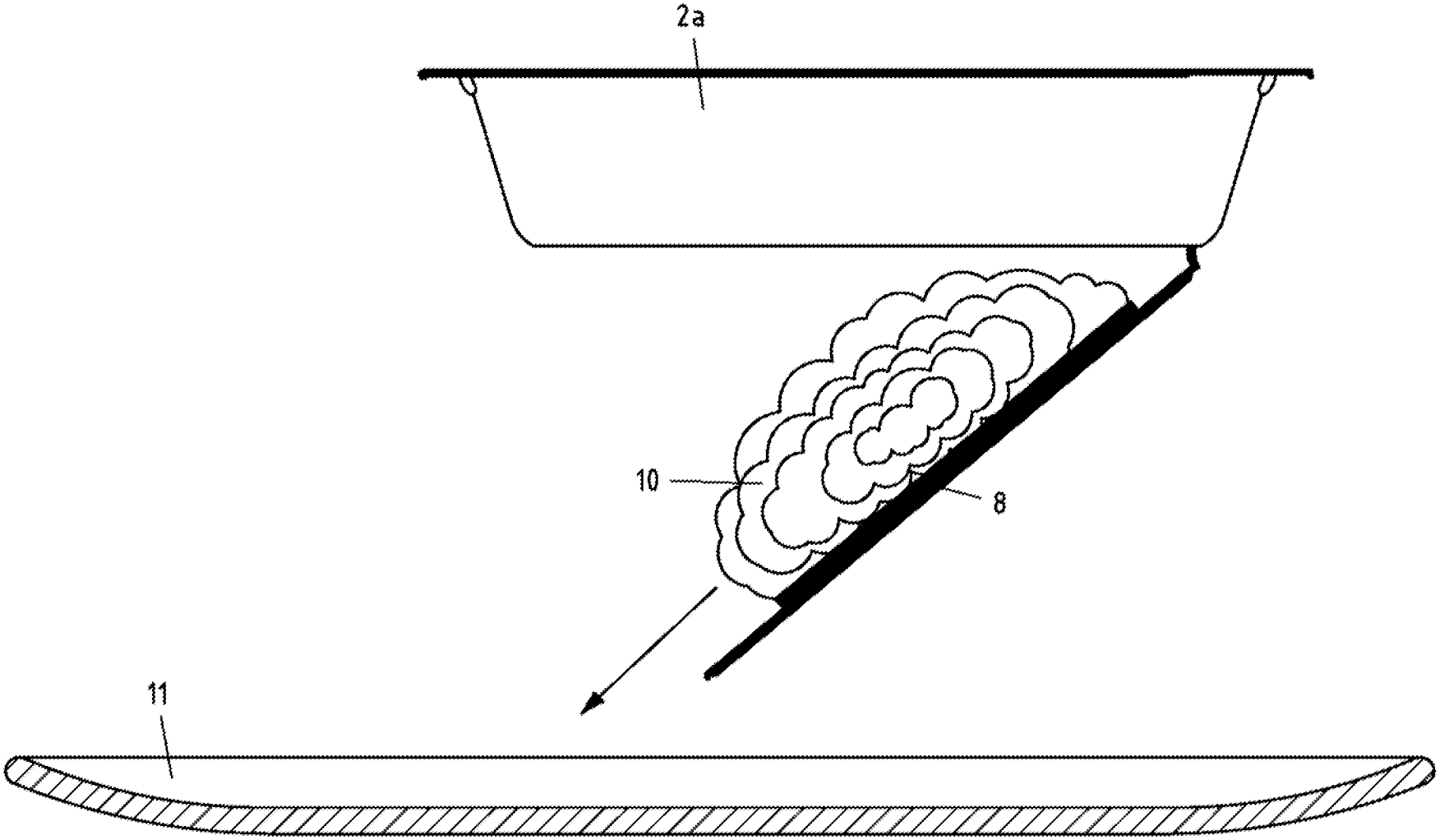

In FIG. 4, a third embodiment of the packaging according to the invention according to the first aspect is shown. The packaging 1 is positioned over a tableware 11, for example, after the food 10 has been heated. The releasable connection 5*a* between the side part 2*a*, 2*b*, 2*c*, 2*d* and the bottom part 3 has been released and the bottom part 3 is connected to the side part 2*a*, 2*b*, 2*c*, 2*d* only by the substantially fixed connection 5*b*.

Food 10 is located on the bottom part 3, preferably the food 10 comprises two or more components. In particular, the food 10 is a ready-made menu.

The bottom part 3 of the packaging 1 has at least partially a non-stick surface 8, in particular a non-stick coating and/or a non-stick structure. When the bottom part 3, after removal of the means 6 for releasably connecting the bottom part 3 to the side part 2*a*, 2*b*, 2*c*, 2*d*, folds down towards the tableware 11, in particular due to the weight of the food 10, the bottom part 3 then forms a ramp over which the food 10 can slide onto the tableware 11. The non-stick surface 8 of the bottom part 3 promotes sliding of the food 10 onto the tableware 11 without food residues remaining in the packaging 1.

In this way, a simple, fast, and substantially complete transfer of the food 10 onto the tableware 11 can be achieved, as well as an appealing presentation of the food 10 on the tableware 11. As a result, the loss of food is extremely low and the waste contains virtually no odorous or unhygienic residue. Moreover, the user of the packaging 1 does not come into contact with the food 10, so that any soiling of hands or clothing is avoided, nor does he need a serving tool to transfer the food 10 onto the tableware 11.

After transferring the food 10 onto the tableware 11, the bottom part 3 can be folded up again and the packaging 1 disposed of without the risk of food residues falling out and leading to soiling.

Figure 5:
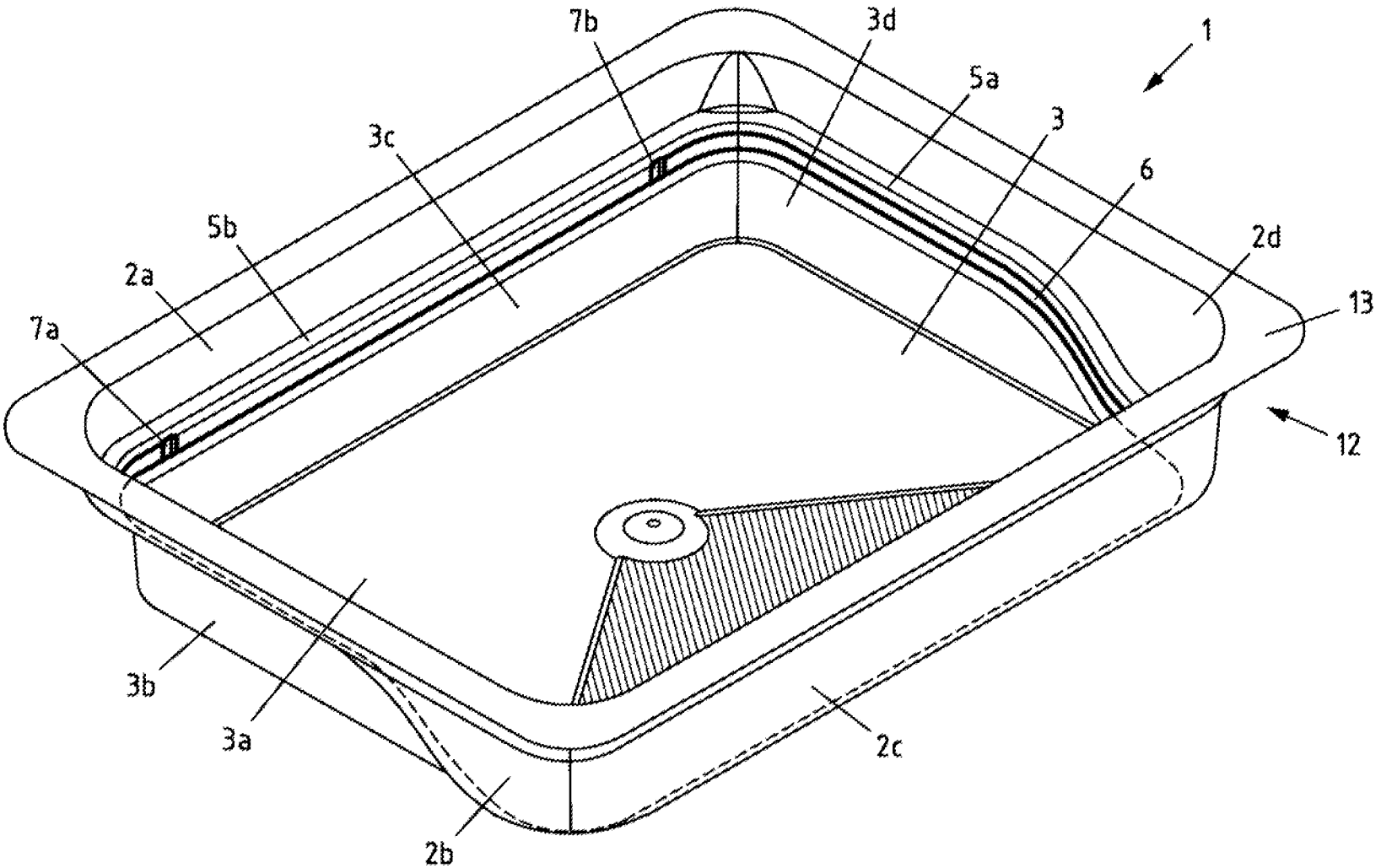

FIG. 5 shows another exemplary embodiment of a packaging for food according to the first aspect. The packaging 1 comprises a side part 2*a*, 2*b*, 2*c*, 2*d* having four sides and forming a substantially rectangular receiving space for receiving at least one food product (not shown). In this regard, the sides 2*a* and 2*c* of the side part 2*a*, 2*b*, 2*c*, 2*d* have, for example, a ratio of about 1 to 1.3 to the sides 2*b* and 2*d*.

The bottom part 3 comprises a bottom section 3*a* and three side sections 3*b*, 3*c*, 3*d*. The side sections 3*b*, 3*c*, 3*d* are formed integrally with each other as well as with the bottom section 3*a* of the bottom part 3. The side section 3*c* extends over the entire side 2*a* and the side sections 3*b*, 3*d* extend at least partially over the sides 2*b* and 2*d* of the side part 2*a*, 2*b*, 2*c*, 2*d*.

The bottom part 3 is releasably connected to the sides 2*b* and 2*d* of the side part 2*a*, 2*b*, 2*c*, 2*d* via the side sections 3*b*, 3*d*. At the sides 2*b* and 2*d*, moreover, the height of the respective side sections 3*b* and 3*d* decreases in the direction of the side 2*c*. The side sections 3*b* and 3*d* fold down together with the bottom section 3*a* of the bottom part 3 after the releasable connection 5*a* has been released, and serve in particular as splash guards for substantially liquid food such as, for example, soups or stews or also pureed food. When transferring food onto, for example, a tableware (not shown), the side sections 3*b* and 3*d* ensure in particular that the food slides as completely as possible onto the tableware.

The bottom part 3 is substantially fixedly connected to the side 2*a* of the side part 2*a*, 2*b*, 2*c*, 2*d* via a part of the side section 3*c*. After the releasable connection 5*a* is released, the bottom section 3*a* and the side sections 3*b*, 3*d* of the bottom part 3 fold down, while the side section 3*c*, which is partly substantially fixedly connected to a part of the side 2*a* of the side part 2*a*, 2*b*, 2*c*, 2*d*, rather folds upwards and/or to the side. This facilitates, in particular, a contactless transfer of frozen foods onto a tableware as well as a subsequent plate regeneration.

The releasable connection 5*a* extends completely over three of the four sides of the side part 2*a*, 2*b*, 2*c*, 2*d* and over the fourth side 2*a* at least partially. The releasable connection 5*b* comprises a means 6 formed as a tear strip for releasably connecting the bottom part 3 to the side part 2*a*, 2*b*, 2*c*, 2*d*. The tear strip has two means 7*a*, 7*b* for releasing the releasable connection 5*a*, which are formed as tabs. The tabs are arranged at opposite ends 6*a*, 6*b* of the tear strip. In this way, the releasable connection 5*a* can be released from both sides and thus in a particularly simple manner by both left-handed and right-handed persons. In addition, symmetrical release of the releasable connection 5*a* is made possible.

The substantially fixed connection 5*b* extends over only a portion of the fourth side 2*a* of the side part 2*a*, 2*b*, 2*c*, 2*d*, thereby particularly facilitating the folding down of the bottom section 3*a* and the side sections 3*b*, 3*d* of the bottom part 3 after the releasable connection 5*b* has been released. The substantially fixed connection 5*b* comprises a reduced thickness of only 0.10 mm and is thus configured in a manner of a hinge. This enables the bottom part 3 to be folded down even when the packaging 1 is empty and/or prevents the bottom part 3 from springing back unintentionally, while at the same time ensuring the substantially fixed connection of the bottom part 3 to the side part 2*a*, 2*b*, 2*c*, 2*d*.

While the side part 2*a*, 2*b*, 2*c*, 2*d* has a thickness of essentially 0.60 mm, the bottom part 3 has different thicknesses. While the bottom part 3 has predominantly a thickness of 0.70 mm, the bottom part 3 has a thickness of 0.75 mm in a flow area (shaded area) where the food is transferred from the bottom part 3 onto a tableware, which gives the bottom part additional stability at this point and facilitates folding down. The side sections 3*b*, 3*c*, 3*d* have a thickness of substantially 0.60 mm corresponding to the side part 2*a*, 2*b*, 2*c*, 2*d*.

Further, the packaging 1 comprises a retaining element 12, which is formed as a sealing edge 13 surrounding the side part 2*a*, 2*b*, 2*c*, 2*d*. The retaining element 12 serves for gripping and/or holding the packaging 1. The sealing edge 13 has a thickness of substantially about 1.00 mm at points which are subjected to particular stress when the releasable connection 5*b* is released, while the sealing edge 13 has a thickness of substantially only about 0.60 mm at comparably less stressed points of the packaging 1, in particular of the side part 2*a*, 2*b*, 2*c*, 2*d*, for example. Thus, for example, in order to release the releasable connection 5*b*, the side 2*a* of the side part 2*a*, 2*b*, 2*c*, 2*d*, in particular the retaining element 12 on this side 2*a*, is held with one hand and a means 7*a*, 7*b* formed as a tab for releasing the releasable connection 5*a* is gripped with the other hand in order to release the releasable connection 5*a* and allow the bottom part 3 to be folded down, as a result of which a correspondingly higher load is produced at this point, which can be compensated for accordingly with a greater thickness.

Figure 6:
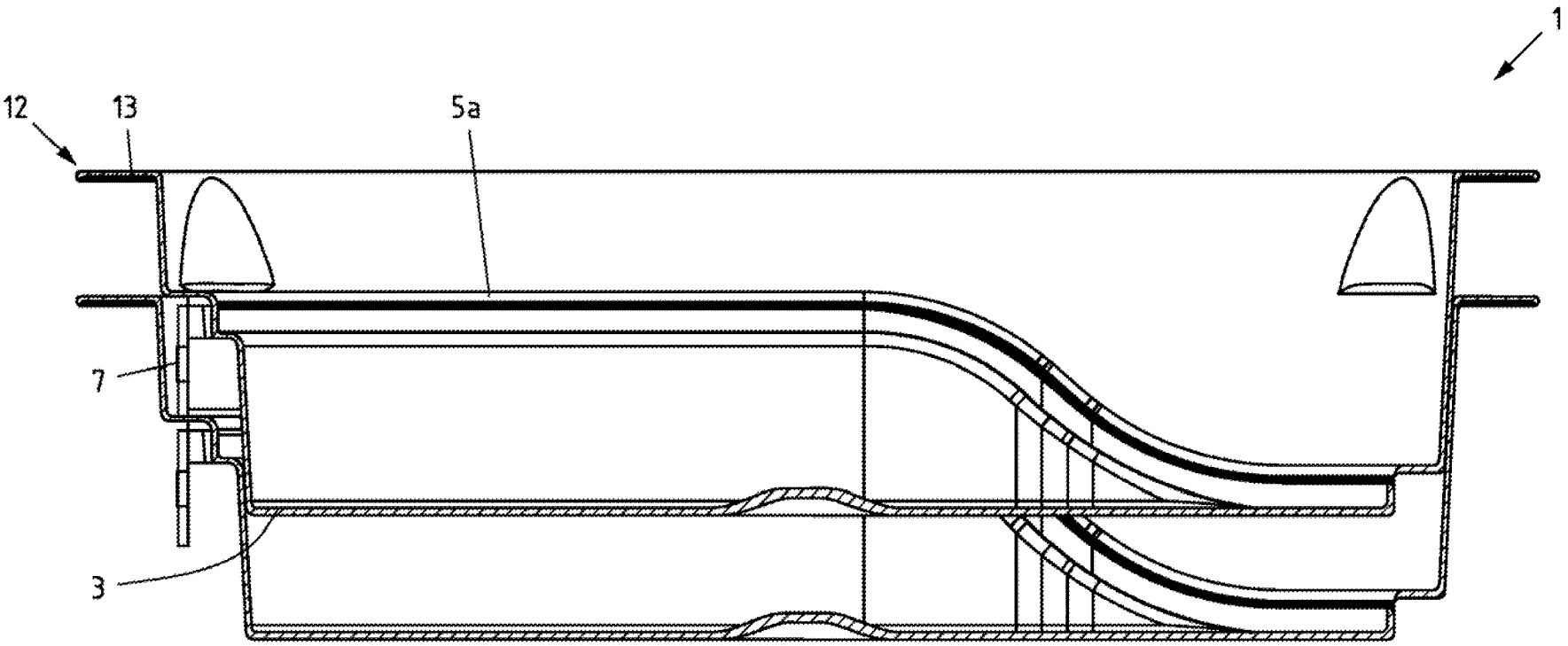

The packaging 1 in FIG. 6 is stacked inside one another with a further packaging 1. The at least one means 7 for releasing the releasable connection 5*a*, which is configured, for example, as a tab, is configured in such a way that the packagings 1 are stacked vertically spaced apart from one another. For this purpose, the lower edge of the means 7 for releasing the releasable connection 5*a* abuts against a shoulder of the lower packaging 1. The vertical spacing between the packagings 1 simplifies gripping of the retaining element 12, which is configured as an at least partially circumferential sealing edge 13. In this way, the stacked packagings 1 can be separated from one another again in a simple manner.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. Packaging, in particular pre-packaging, for food, comprising:

a side part, the side part enclosing a receiving space for food, and a bottom part, the bottom part being connected to the side part, a connection between the side part and the bottom part comprising at least partially a releasable connection, wherein, the connection between the side part and the bottom part comprises at least partially a permanent connection, the permanent connection being at least partially movable, the at least partially movable configuration of the permanent connection allowing a hinge effect between the side part and the bottom part, wherein the bottom part can be folded down after an at least partial release of the releasable connection and form a ramp over which food contained in the packaging can slide onto a tableware.

2. The packaging according to claim 1, wherein, the releasable connection comprises at least one means for releasably connecting the bottom part to the side part, in particular a releasable tear strip.

3. The packaging according to claim 2, wherein, the at least one means for releasably connecting the bottom part to the side part has at least one means for releasing the releasable connection, in particular at least one tab.

4. The packaging according to claim 3, wherein, the at least one means for releasably connecting the bottom part to the side part has two means for releasing the releasable connection, in particular two tabs, the means for releasing the releasable connection being arranged at opposite ends of the means for releasably connecting the bottom part to the side part.

5. The packaging according to claim 1, wherein the bottom part is essentially rigid.

6. The packaging according to claim 1, wherein the bottom part has a thickness of at least 0.20 mm, preferably at least 0.40 mm, particularly preferably at least 0.60 mm.

7. The packaging according to claim 1, wherein the bottom part and/or the side part at least partially have a thickness of 0.2 to 2.0 mm, preferably 0.3 to 1.0 mm, particularly preferably 0.60 to 0.75 mm.

8. The packaging according to claim 7, wherein the side part has at least partially a thickness of 0.50 to 0.70 mm, preferably 0.55 to 0.65 mm, in particular 0.60 mm, and/or the bottom part has at least partially a thickness of 0.60 to 0.80 mm, preferably 0.70 to 0.75 mm, in particular 0.70 mm.

9. The packaging according to claim 1, wherein the permanent connection is at least partially flexible.

10. The packaging according to claim 1, wherein the bottom part at least partially has a non-stick surface, in particular a non-stick coating and/or a non-stick structure.

11. The packaging according to claim 1, wherein the side part and/or the bottom part comprises a heat-resistant, preferably microwaveable material, in particular plastic and/or light metal.

12. The packaging according to claim 1, wherein the packaging further comprises a releasable and/or resealable lid.

13. The packaging according to claim 1, wherein the bottom part comprises at least one bottom section and at least one side section, the bottom section being at least partially connected to the side section at an angle of not equal to 0°, in particular of essentially 90°, preferably formed integrally with the side section.

14. The packaging according to claim 1, wherein the packaging comprises at least one retaining element, in particular an at least partially circumferential sealing edge.

15. A method for serving, in particular for appealingly providing, food, comprising the steps:

placing the packaging according to claim 1 on or over a tableware, at least partially loosening the releasable connection of the packaging, and at least partial opening of the bottom part so that food contained in the packaging can be transferred, in particular slide, from the packaging via the bottom part onto a tableware.

16. Use of the packaging according to claim 1 for serving, in particular for appealingly providing, food in a large-scale kitchen and/or in a communal catering facility, in particular in a hospital, a retirement home and/or a care facility.

* * * * *